US006955350B2

(12) United States Patent
Hashiguchi et al.

(10) Patent No.: US 6,955,350 B2
(45) Date of Patent: Oct. 18, 2005

(54) SHEET MEMBER POSITIONING DEVICE

(75) Inventors: Akihiro Hashiguchi, Kanagawa (JP); Kazuhisa Okamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 222 days.

(21) Appl. No.: 10/277,977

(22) Filed: Oct. 23, 2002

(65) Prior Publication Data

US 2003/0075860 A1 Apr. 24, 2003

(30) Foreign Application Priority Data

Oct. 23, 2001 (JP) ..... 2001-324454

(51) Int. Cl.[7] ..... B65H 9/04
(52) U.S. Cl. ..... 271/255; 271/171; 271/223
(58) Field of Search ..... 271/255, 171, 271/241, 223; 270/58.04, 58.12, 58.16

(56) References Cited

U.S. PATENT DOCUMENTS 3,809,385 A * 5/1974 Rana ..... 270/52.29
4,597,652 A * 7/1986 Dodge ..... 396/562
5,172,138 A * 12/1992 Okazawa et al. ..... 346/134
5,271,706 A * 12/1993 Helbach et al. ..... 414/676
5,358,236 A * 10/1994 Maass et al. ..... 271/248
5,718,057 A 2/1998 Rosli et al.
5,903,812 A * 5/1999 Kondoh et al. ..... 399/373
5,988,621 A * 11/1999 Kondo et al. ..... 271/3.02
6,014,229 A * 1/2000 Yun ..... 358/449
6,073,925 A * 6/2000 Sato ..... 271/171
6,233,038 B1 * 5/2001 Lennhoff et al. ..... 355/47

FOREIGN PATENT DOCUMENTS

DE 526 028 C 6/1931
EP 0 344 363 A1 12/1989

* cited by examiner

*Primary Examiner*—Patrick Mackey
(74) *Attorney, Agent, or Firm*—Sughrue Mion, PLLC

(57) ABSTRACT

A sheet member positioning device includes a plate on which a sheet member is loaded; a reference member provided at a side, in a first direction, of the plate, the sheet member being able to abut the reference member; a conveying member provided at a side, in a second direction, of the plate, and due to the conveying member being moved toward the side in the first direction and conveying the sheet member, the conveying member makes the sheet member abut the reference member so as to determine a position of the sheet member in the first direction; and a detecting mechanism which, at a time when the position of the sheet member in the first direction is determined, detects a distance between the reference member and the conveying member, and detects a size of the sheet member on the basis of the detected distance.

20 Claims, 4 Drawing Sheets

SHEET MEMBER POSITIONING DEVICE

BACKGROUND OF THE INVENTION

1. Field of the Invention

The present invention relates to a sheet member positioning device which positions a sheet member.

2. Description of the Related Art

Printing plate exposure devices have been developed which expose (record) an image directly by a laser beam or the like onto an image forming layer (photosensitive layer, emulsion surface) on a support of a sheet-shaped printing plate (for example, a so-called photopolymer plate or a thermal plate).

In such a printing plate exposure device, the printing plate which is loaded on a flat-plate-shaped plate is, as needed, conveyed to a punching section, and is subjected to punching processing (a processing for forming punch holes) at the punching section. Further, the printing plate, which is loaded on the plate, is conveyed to an exposure section, and exposure processing of the printing plate is carried out at the exposure section.

In order to improve the accuracy of the punching processing and the exposure processing, the printing plate must be positioned at a predetermined printing plate positioning device before the punching processing in the punching section and the exposure processing in the exposure section.

Here, if the size of the printing plate can be detected simultaneously with the positioning of the printing plate by using the printing plate positioning device, there is no need for a separate mechanism for detecting the size of the printing plate, and costs can therefore be reduced. Further, because there is no need for a separate period of time for detecting the size of the printing plate, it is possible to prevent the productivity from deteriorating.

SUMMARY OF THE INVENTION

In view of the aforementioned, an object of the present invention is to provide a sheet member positioning device which aims for lower costs and prevention of deterioration in productivity.

A sheet member positioning device relating to a first aspect of the present invention comprises: a plate on which a sheet member is loaded; a reference member provided at a side, in a first direction, of the plate, the sheet member being able to abut the reference member; a conveying member provided at a side, in a second direction, of the plate, and due to the conveying member being moved toward the side in the first direction and conveying the sheet member, the conveying member makes the sheet member abut the reference member so as to determine a position of the sheet member in the first direction; and a detecting mechanism which, at a time when the position of the sheet member in the first direction is determined, detects a distance between the reference member and the conveying member, and detects a size of the sheet member on the basis of the detected distance.

In the sheet member positioning device, the conveying member is moved toward the side in the first direction, and conveys the sheet member on the plate. In this way, the sheet member abuts the reference member, and the position of the sheet member in the first direction is determined.

Here, at the time when the position of the sheet member in the first direction is determined, the detecting mechanism detects the distance between the reference member and the conveying member, and detects the size of the sheet member on the basis of the detected distance. Accordingly, the size of the sheet member can be detected by using the sheet member positioning device. The size of the sheet member can be detected simultaneously with the determining of the position of the sheet member in the first direction. There is no need to separately detect the size of the sheet member. In this way, there is no need for a separate mechanism for detecting the size of the sheet member, and costs can be reduced. Moreover, because there is no need for a separate period of time for detecting the size of the sheet member, it is possible to prevent deterioration in productivity.

Further, another aspect of the present invention is a method of positioning a sheet member in a sheet member positioning device which includes a reference member and a conveying member which are set apart from one another by a predetermined distance, a plate, and a detecting mechanism, the method comprising the steps of: (a) supplying a sheet member to the plate; (b) abutting the sheet member, which is supplied to the plate, against the reference member, which is provided at a side in a first direction of the plate, by the conveying member; (c) detecting a distance between the reference member and the conveying member by the detecting mechanism; and (d) detecting a size of the sheet member on the basis of the detected distance.

DESCRIPTION OF THE PREFERRED EMBODIMENT

Figure 2:
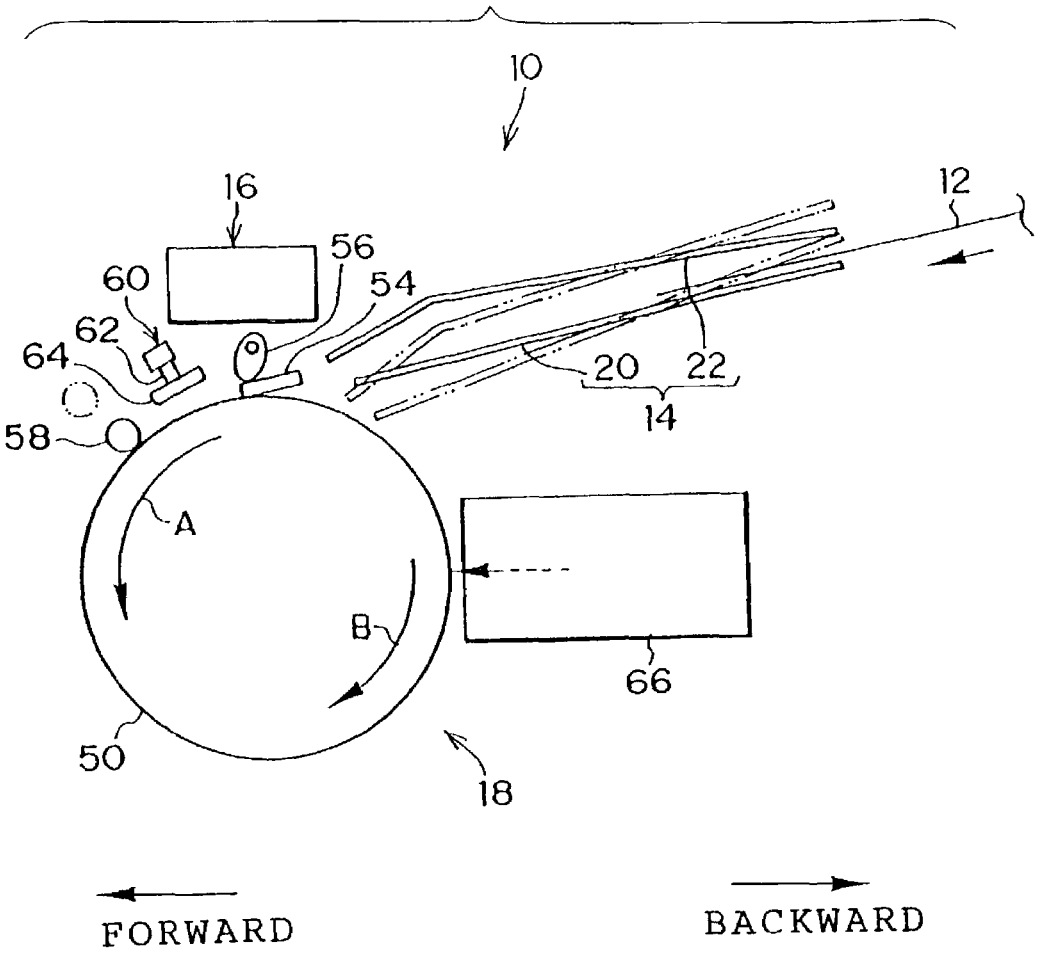
FIG. 2 is a side view showing the automatic printing plate exposure device relating to the embodiment of the present invention.

FIG. 2 shows an automatic printing plate exposure device 10 relating to the present embodiment, and structured such that the sheet member positioning device of the present invention is applied thereto.

The automatic printing plate exposure device 10 relating to the present embodiment is a device which exposes (records) an image onto an image forming layer (a photosensitive layer, an emulsion surface) on a support of a sheet-shaped printing plate 12 such as a photopolymer plate, a thermal plate, or the like. The automatic printing plate exposure device 10 is divided into a conveying guide unit 14, a punching section 16, and an exposure section 18. The punching section 16 and the exposure section 18 are disposed ahead of the conveying guide unit 14, and the exposure section 18 is disposed beneath the punching section 16.

The conveying guide unit 14 includes a plate supplying guide 20 which serves as a plate and is a substantially rectangular flat-plate shape, and a plate discharging guide 22 which is a substantially rectangular flat-plate shape. The relative positional relationship of the plate supplying guide 20 and the plate discharging guide 22 is such that the guides 20, 22 are disposed to form a sideways V-shape. The conveying guide unit 14 rotates a predetermined angle around a vicinity of the center of FIG. 2. Due to this rotation, the conveying guide unit 14 can make the plate supplying guide 20 and the plate discharging guide 22 selectively correspond to the punching section 16 or the exposure section 18. The printing plate 12 is supplied to and loaded on the plate supplying guide 20, and the size of the printing plate 12 is inputted in advance to the automatic printing plate exposure device 10.

Figure 1:
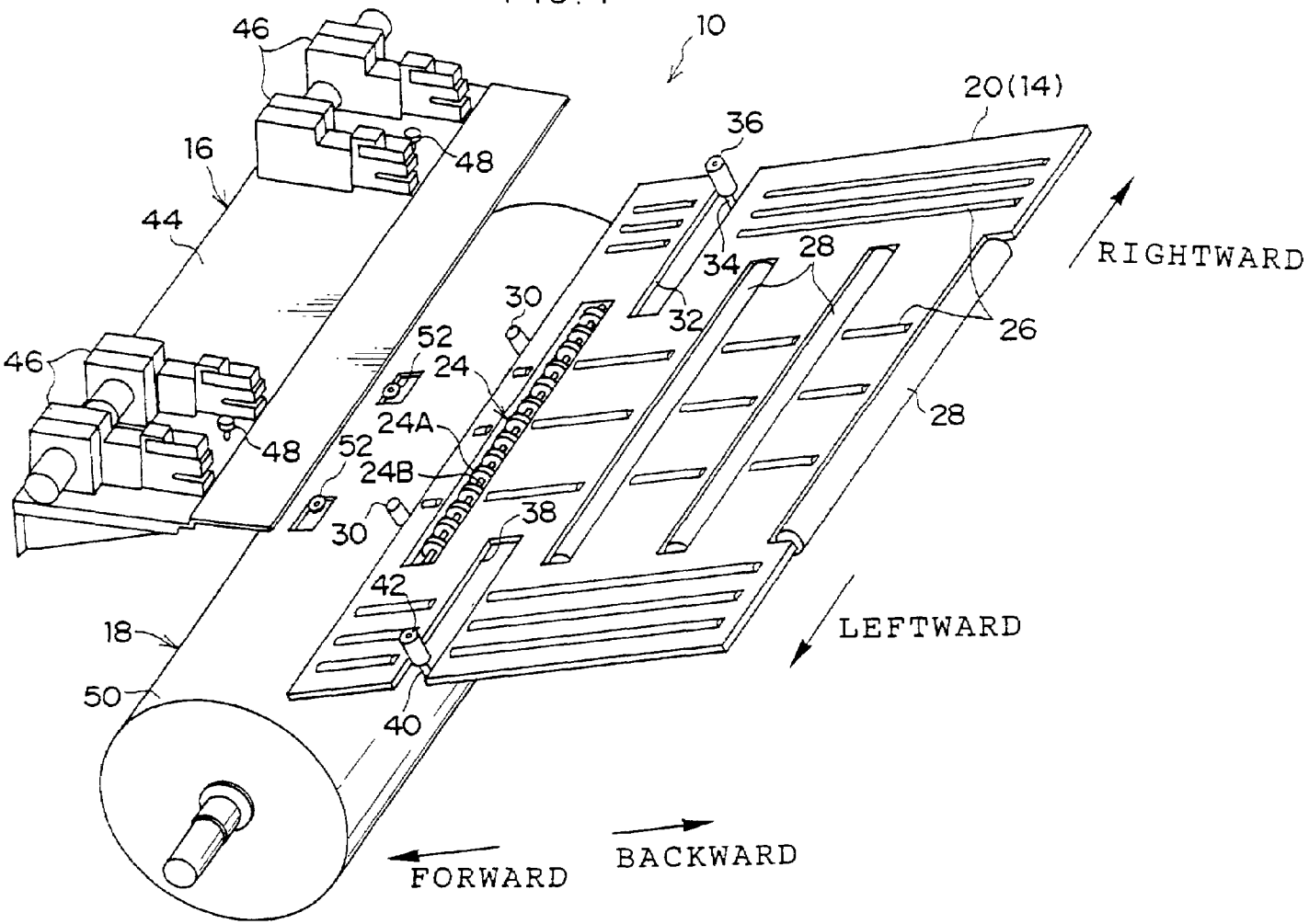
FIG. 1 is a perspective view showing an automatic printing plate exposure device relating to an embodiment of the present invention.

As shown in FIG. 1, a conveying roller 24 is rotatably provided at the front side region of the plate supplying guide 20. The conveying roller 24 is a skewer-like structure in which a plurality of cylindrical roller portions 24A formed of silicon rubber are aligned at a rotating central shaft 24B which is parallel to the left-right direction. The conveying roller 24 projects above the top surface of the plate supplying guide 20. Due to the conveying roller 24 being driven to rotate in a state in which the bottom surface of the printing plate 12 is contacting the conveying roller 24, the printing plate 12 is conveyed forward.

A predetermined number of ribs 26, which are formed in trapezoidal column shapes, are provided on the plate supplying guide 20. The ribs 26 are disposed parallel to the front-back direction. The height by which the ribs 26 project out above the top surface of the plate supplying guide 20 is slightly lower than that of the conveying roller 24. A predetermined number of cylindrical rotating rollers 28 are provided on the plate supplying guide 20 so as to be freely rotatable. The rotating rollers 28 are disposed parallel to the left-right direction. The height by which the rotating rollers 28 project out above the top surface of the plate supplying guide 20 is substantially the same as that of the conveying roller 24. Here, due to the supporting of the printing plate 12 on the ribs 26 and the rotation of the rotating rollers 28 which accompanies the conveying of the printing plate 12, the frictional force at the time of conveying the printing plate 12 can be reduced.

A pair of positioning pins 30 are provided at the front end of the plate supplying guide 20 parallel to the left-right direction. The positioning pins 30 are formed as cylinders, are freely rotatable around central shafts, and project out with respect to the top surface of the plate supplying guide 20. Further, the pair of positioning pins 30 can be lowered from the top surface of the plate supplying guide 20. When the printing plate 12 is conveyed forward due to the rotation of the conveying roller 24 as described above, the front end of the printing plate abuts the pair of positioning pins 30. In this way, the position of the printing plate 12 in the front-back direction is determined. Next, the pair of positioning pins 30 are lowered from the top surface of the plate supplying guide 20. Due to the rotation of the conveying roller 24, the printing plate 12 is conveyed forward so as to cross over the front end of the plate supplying guide 20.

Figure 4:
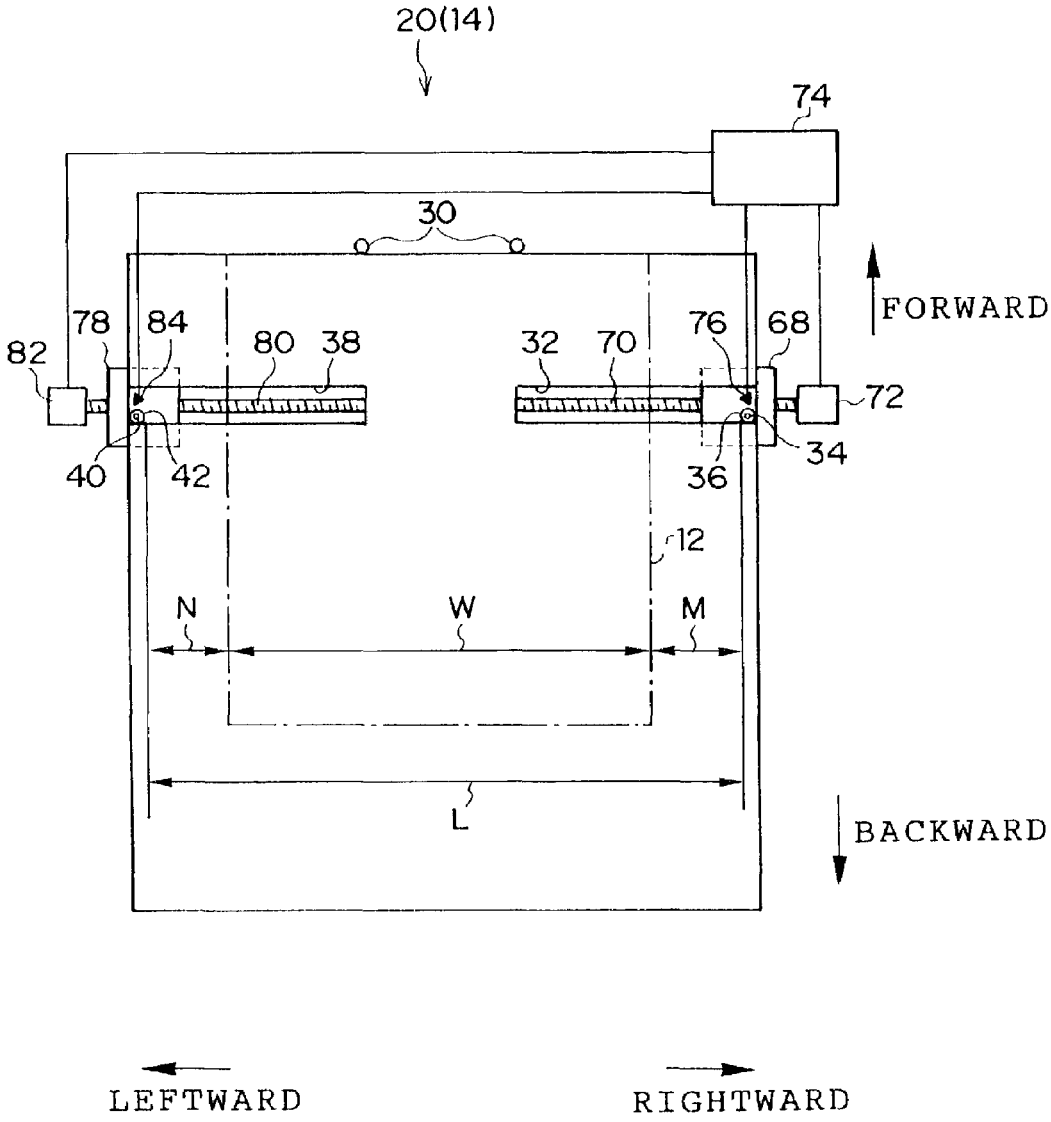
FIG. 4 is a plan view showing a plate supplying guide in the automatic printing plate exposure device relating to the embodiment of the present invention.

A slit 32 is formed in the right side region of the plate supplying guide 20 in a vicinity behind the conveying roller 24. The slit 32 is disposed parallel to the left-right direction, and a supporting shaft 34 passes through the interior thereof. As shown in FIG. 4, the supporting shaft 34 is supported on a supporting stand 68 which is beneath the plate supplying guide 20. A male screw 70 which is a ball screw is screwed together with the supporting stand 68, and the supporting stand 68 stands upright with respect to the male screw 70. The male screw 70 is disposed parallel to the left-right direction directly beneath the slit 32. The male screw 70 is connected to a driving shaft of a pulse motor 72 which forms a detecting mechanism. The pulse motor 72 is connected to a control device 74 which forms the detecting mechanism. Due to the pulse motor 72 being driven, the male screw 70 is rotated, and the supporting stand 68 moves in the left-right direction while the state in which the supporting stand 68 stands upright with respect to the male screw 70 is maintained.

A cylindrical reference pin 36, which serves as a reference member, is supported at the top portion of the supporting shaft 34 so as to be freely rotatable around the supporting shaft 34. The reference pin 36 projects further upward than the top surface of the plate supplying guide 20, and can abut the printing plate 12 on the plate supplying guide 20. The right end portion of the plate supplying guide 20 is the base position of the reference pin 36. Due to the movement of the supporting stand 68 due to the driving of the pulse motor 72, the supporting shaft 34 is moved along the slit 32. Due to the reference pin 36 being moved toward the left (a second direction), the reference pin 36 is positioned at a predetermined position in accordance with the size of the printing plate 12 which is inputted to the automatic printing plate exposure device 10 as described above. Further, on the basis of the number of driving pulses of the pulse motor 72 from the start of movement of the reference pin 36 from its base position to the time when the reference pin 36 is positioned at the aforementioned predetermined position, a control device 74 computes a distance M which the reference pin 36 has moved toward the left from its base position until it is positioned at the aforementioned predetermined position.

A reference sensor 76, which forms the detecting mechanism, is provided at a side of the supporting shaft 34 (in the present embodiment, at the front side of the supporting shaft 34) at the top surface of the supporting stand 68. Due to the reference sensor 76 sensing the right edge of the printing plate 12, it can be detected that the printing plate 12 has abutted the reference pin 36 as will be described later. The reference sensor 76 is connected to the control device 74.

As shown in FIG. 1, a slit 38 is formed in the left side region of the plate supplying guide 20 in a vicinity behind the conveying roller 24. The slit 38 is disposed parallel to the left-right direction, and a supporting shaft 40 passes through the interior thereof. As shown in FIG. 4, the supporting shaft 40 is supported on a supporting stand 78 which is beneath the plate supplying guide 20. A male screw 80 which is a ball screw is screwed together with the supporting stand 78, and the supporting stand 78 stands upright with respect to the male screw 80. The male screw 80 is disposed parallel to the left-right direction directly beneath the slit 38. The male screw 80 is connected to a driving shaft of a pulse motor 82 which forms the detecting mechanism. The pulse motor 82 is connected to the control device 74. Due to the pulse motor 82 being driven, the male screw 80 is rotated, and the supporting stand 78 moves in the left-right direction while the state in which the supporting stand 78 stands upright with respect to the male screw 80 is maintained.

Figure 3:
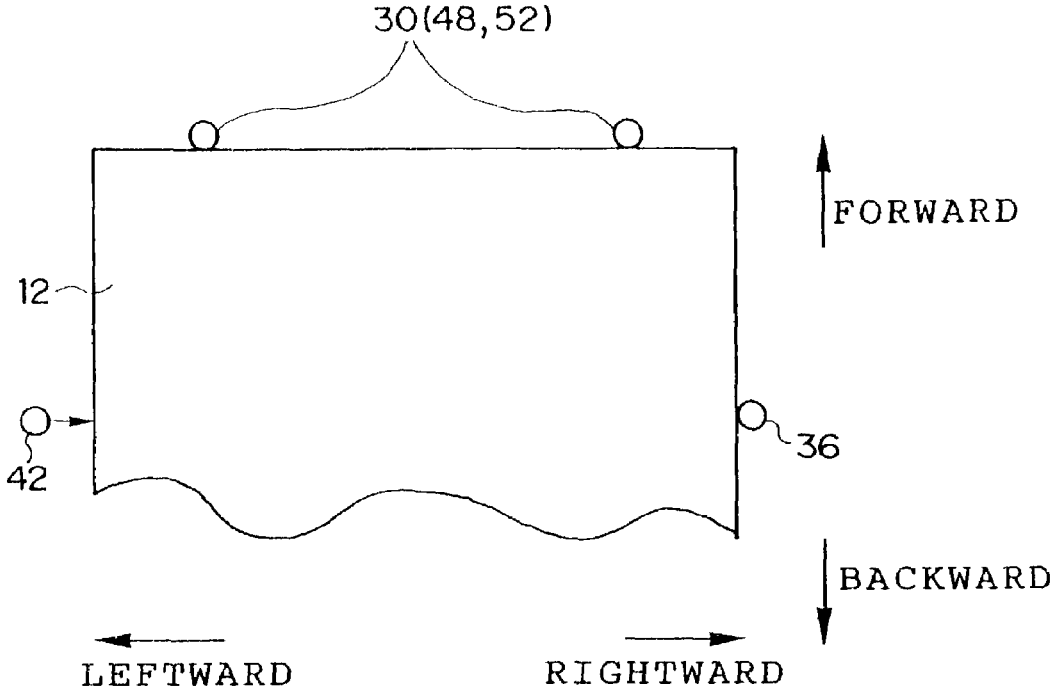
FIG. 3 is a plan view showing a positioned state of the printing plate, in the automatic printing plate exposure device relating to the embodiment of the present invention.

A cylindrical conveying pin 42, which serves as a conveying member, is supported at the top portion of the supporting shaft 40 so as to be freely rotatable around the supporting shaft 40. The conveying pin 42 projects further upward than the top surface of the plate supplying guide 20, and opposes the reference pin 36 in the left-right direction. The left end portion of the plate supplying guide 20 is the base position of the conveying pin 42. The conveying pin 42, which is disposed at its base position, and the reference pin 36, which is disposed at its base position, are separated in the left-right direction by a distance L. Here, as described above, when the printing plate 12 abuts the pair of positioning pins 30 and the position of the printing plate 12 in the front-back direction is determined, due to the movement of the supporting stand 78 due to the driving of the pulse motor 82, the supporting shaft 40 is moved along the slit 38 and the conveying pin 42 is moved toward the right (a first direction). The conveying pin 42 thereby pushes the printing plate 12 so as to convey the printing plate 12 toward the right. The movement of the conveying pin 42 stops after the printing plate 12 has abutted the reference pin 36. In this way, the position of the printing plate 12 in the right direction is determined, and as shown in FIG. 3, the printing plate 12 is temporarily positioned. Note that buckling deformation of the printing plate 12 due to the pushing force of the conveying pin 42 can be prevented by structuring the supporting shaft 40 so as to be able to move in a state in which a predetermined elastic force is applied toward the reference pin 36 side.

A conveying sensor 84, which forms the detecting mechanism, is provided at a side of the supporting shaft 40 (in the present embodiment, at the front side of the supporting shaft 40) at the top surface of the supporting stand 78. The conveying sensor 84 is connected to the conveying pin 42 either directly or indirectly. The conveying sensor 84 senses that a load of a predetermined amount has been applied to the conveying pin 42 due to the printing plate 12, which is being conveying by the conveying pin 42, abutting the reference pin 36. The conveying sensor 84 is connected to the control device 74. The control device 74 computes a distance N, which the conveying pin 42 moves from its base position to the right until the printing plate 12 abuts the reference pin 36, on the basis of the number of driving pulses of the pulse motor 82 from the start of movement of the conveying pin 42 from its base position, to the time the reference sensor 76 detects that the printing plate 12 has abutted the reference pin 36 and the conveying sensor 84 detects that a load of the predetermined amount has been applied to the conveying pin 42.

The reference pin 36, which is disposed at its base position, and the conveying pin 42, which is disposed at its base position, are separated in the left-right direction by the distance L. Further, the distance M, which the reference pin 36 moves toward the left from its base position to being disposed at the aforementioned predetermined position, is computed. Moreover, the distance N, which the conveying pin 42 moves toward the right from its base position until the printing plate 12 abuts the reference pin 36, is computed. Thus, due to the control device 74 computing the value L-M-N (which is equal to a distance W of separation in the left-right direction between the reference pin 36 and the conveying pin 42 at the time when the position of the printing plate 12 in the right direction is determined), an actual length W of the printing plate 12 in the left-right direction is detected (computed).

Further, the control device 74 computes the difference between the actual length W in the left-right direction of the printing plate 12, and a length in the left-right direction of the printing plate 12 which is determined from the size of the printing plate 12 inputted in advance to the automatic printing plate exposure device 10. If this difference is greater than or equal to a given amount (e.g., ±5 mm), error processing is carried out. Examples of this error processing are processing for stopping the automatic printing plate exposure device 10, processing for discharging the printing plate 12 from the plate supplying guide 20 by rotation of the conveying guide unit 14, and the like.

As shown in FIG. 1, the punching section 16 has a flat-plate-shaped supporting plate 44. A predetermined number of punching devices 46 are supported on the supporting plate 44. (In the present embodiment, a pair of punching devices 46 is provided at each of the left and the right, for a total of four punching devices 46.) Here, the conveying guide unit 14 is rotated such that the plate supplying guide 20 corresponds to the punching section 16 (opposes the punching devices 46), and the pair of positioning pins 30 are lowered from the top surface of the plate supplying guide 20. In this way, the front end portion of the printing plate 12 can be conveyed by the rotation of the conveying roller 24 from the plate supplying guide 20 into the punching devices 46.

A positioning pin 48 is provided between the two punching devices 46 of each pair of punching devices 46. This pair of positioning pins 48 is disposed parallel to the left-right direction. Each positioning pin 48 is cylindrical, and rotates freely around a central shaft. The front end of the printing plate 12 conveyed into the punching devices 46 abuts the pair of positioning pins 48. In this way, the position of the printing plate 12 in the front-back direction is determined. Moreover, in this state, the conveying pin 42 is moved and conveys the printing plate 12 to the right, and after the printing plate 12 has abutted the reference pin 36, movement of the conveying pin 42 is stopped. The position of the printing plate 12 in the right direction is thereby determined. In this way, as shown in FIG. 3, the printing plate 12 is actually positioned in the punching section 16. Further, the left-right direction central line of the printing plate 12 which is actually positioned coincides with the left-right direction central line of the pair of positioning pins 48 and the two pairs of punching devices 46.

A predetermined number of punch holes (not shown), which are, for example, round holes or elongated holes or the like, are formed by the punching devices 46 in the front end portion of the printing plate 12 which is actually positioned. As will be described later, the predetermined number of punch holes serve as a reference for winding the printing plate 12 onto a plate cylinder of a rotary press of a printing device (not shown) on which the printing plate 12 is conveyed, and are used in positioning the printing plate 12 for the printing processing at the printing device.

When the processing at the punching devices 46 is completed, by rotating the conveying roller 24 reversely, the printing plate 12 is returned onto the plate supplying guide 20. The pair of positioning pins 30 are projected from the top surface of the plate supplying guide 20, and the printing plate 12 is again temporarily positioned as described above.

The exposure section 18 is equipped with a cylindrical rotating drum 50. The rotating drum 50 is disposed parallel to the left-right direction, and can rotate in the direction of arrow A and the direction of arrow B in FIG. 2. Here, when the printing plate 12, which has returned onto the plate supplying guide 20 from the punching section 16, is temporarily positioned as mentioned above, the conveying guide unit 14 is rotated such that the plate supplying guide 20 corresponds to the exposure section 18 (opposes the rotating drum 50 in a direction tangent to the rotating drum 50), and the pair of positioning pins 30 are lowered from the top surface of the plate supplying guide 20. In this way, the front end of the printing plate 12 is conveyed by the conveying roller 24 onto the outer periphery of the rotating drum 50.

A pair of positioning pins 52 are provided at the outer periphery of the rotating drum 50. The pair of positioning pins 52 is disposed parallel to the left-right direction. Each positioning pin 52 is cylindrical, and rotates freely around a central shaft. The front end of the printing plate 12 conveyed onto the outer periphery of the rotating drum 50 abuts the pair of positioning pins 52. In this way, the position of the printing plate 12 in the front-back direction is determined. Moreover, in this state, the conveying pin 42 is moved and conveys the printing plate 12 toward the right. Movement of the conveying pin 42 stops after the printing plate 12 has abutted the reference pin 36. The position of the printing plate 12 in the right direction is thereby determined. In this way, as shown in FIG. 3, the printing plate 12 is actually positioned in the exposure section 18.

As shown in FIG. 2, a plate-shaped front end chuck 54 is provided, in a vicinity of the pair of positioning pins 52, at the outer periphery of the rotating drum 50. The substantial central portion of the front end chuck 54 in the front-back direction is pivotably supported at the rotating drum 50. Elastic force, in a direction of moving away from the outer periphery of the rotating drum 50, is applied to the front side of the front end chuck 54.

An attaching cam 56 is provided above the front end chuck 54. Due to the attaching cam 56 pushing the front side of the front end chuck 54, the rear side of the front end chuck 54 moves apart from the outer periphery of the rotating drum 50. In this way, the front end of the printing plate 12, which is conveyed onto the outer periphery of the rotating drum 50 from the plate supplying guide 20 as described above, is inserted between the rear side of the front end chuck 54 and the outer periphery of the rotating drum 50, and in this state, the above-described actual positioning of the printing plate 12 is carried out. Further, after the above-described actual positioning of the printing plate 12 has been completed, the attaching cam 56 is rotated and the pushing of the front side of the front end chuck 54 is cancelled. When the pushing of the front side of the front end chuck 54 is cancelled, the front end chuck 54 rotates due to the aforementioned elastic force which is applied to the front side of the front end chuck 54, and the rear side of the front end chuck 54 presses the front end of the printing plate 12. In this way, the front end of the printing plate 12 is held at the outer periphery of the rotating drum 50. When the front end of the printing plate 12 is held at the outer periphery of the rotating drum 50, the rotating drum 50 is rotated in the direction of arrow A in FIG. 2, and the printing plate 12 is taken up onto the outer periphery of the rotating drum 50.

A squeeze roller 58 is disposed in a vicinity of the outer periphery of the rotating drum 50, at the arrow A direction side (in FIG. 2) of the attaching cam 56. The printing plate 12 wound on the rotating drum 50 is rotated while being pressed toward the rotating drum 50 due to the squeeze roller 58 being moved toward the rotating drum 50, and the printing plate 12 is closely contacted with the outer periphery of the rotating drum 50.

A rear end chuck attaching/removing unit 60 is disposed between the attaching cam 56 and the squeeze roller 58 in a vicinity of the outer periphery of the rotating drum 50. The rear end chuck attaching/removing unit 60 has a shaft 62. The shaft 62 is movable toward the rotating drum 50. A rear end chuck 64 is mounted to the distal end of the shaft 62. When the rear end of the printing plate 12 wound on the rotating drum 50 opposes the rear end chuck attaching/removing unit 60, the shaft 62 moves the rear end chuck 64 toward the rotating drum 50, and attaches the rear end chuck 64 to a predetermined position of the rotating drum 50. Simultaneously, the rear end chuck 64 separates from the shaft 62. In this way, the rear end chuck 64 presses the rear end of the printing plate 12 such that the rear end of the printing plate 12 is held on the outer periphery of the rotating drum 50.

When the front end and the rear end of the printing plate 12 are held at the rotating drum 50 by the front end chuck 54 and the rear end chuck 64, the squeeze roller 58 moves away from the rotating drum 50. After the squeeze roller 58 moves away from the rotating drum 50, the rotating drum 50 is rotated at high speed at a predetermined rotational speed.

A recording head portion 66 is disposed in a vicinity of the outer periphery of the rotating drum 50. Synchronously with the rotation of the rotating drum 50 which is being rotated at high speed, the recording head portion 66 irradiates a laser beam which has been modulated on the basis of read image data. The printing plate 12 is thereby exposed on the basis of the image data. This exposure processing is so-called scanning-exposure in which, while the rotating drum 50 is rotating at high speed (while main scanning is carried out), the recording head portion 66 is moved in the axial direction of the rotating drum 50 (subscanning is carried out).

When the scan-exposure of the printing plate 12 is completed, the rotating drum 50 is temporarily stopped at the position where the rear end chuck 64 opposes the shaft 62. Then, the rear end chuck 64 is removed from the rotating drum 50 by the shaft 62 (the rear end chuck 64 is attached to the shaft 62), and the pressing of the rear end of the printing plate 12 by the rear end chuck 64 is released. Moreover, after the conveying guide unit 14 is rotated such that the plate discharging guide 22 corresponds to the exposure section 18, i.e., after the conveying guide unit 14 is rotated such that the plate discharging guide 22 opposes the rotating drum 50 in a direction tangential to the rotating drum 50, the rotating drum 50 is rotated in the direction of arrow B in FIG. 2. The printing plate 12 is thereby conveyed backward from the rear end side thereof, and is discharged to the plate discharging guide 22. At this time, due to the attaching cam 56 being rotated and pushing the front side of the front end chuck 54, the pressing of the front end of the printing plate 12 by the rear side of the front end chuck 54 is released. Further, when the printing plate 12 is sent to the plate discharging guide 22, the conveying guide unit 14 is pivoted, and the printing plate 12 is discharged from the plate discharging guide 22. The printing plate 12 is thereby conveyed to a developing device or a printing device (both not shown) which is the subsequent process adjacent the automatic printing plate exposure device 10.

Next, operation of the present embodiment will be described.

First, the printing plate 12 is loaded on the plate supplying guide 20. At this time, the printing plate 12 may be fed-in by so-called manual feeding, or may be fed-in by an automatic plate feeding device or the like.

The printing plate 12 on the plate supplying guide 20 is loaded in a state in which the loaded position and the inclination and the like of the printing plate 12 with respect to the plate supplying guide 20 are relatively rough. In this state, the printing plate 12 is conveyed forward by the rotation of the conveying roller 24 such that the front end of the printing plate 12 abuts the pair of positioning pins 30. After the front end of the printing plate 12 abuts the positioning pins, the printing plate 12 is conveyed toward the right by the conveying pin 42, and abuts the reference pin 36. The printing plate 12 is thereby temporarily positioned.

When the printing plate 12 is in this temporarily positioned state, the conveying guide unit 14 is pivoted such that the plate supplying guide 20 is made to correspond to the punching section 16. Simultaneously, the pair of positioning pins 30 are lowered from the top surface of the plate supplying guide 20, the printing plate 12 is conveyed forward by the rotation of the conveying roller 24, and the front end of the printing plate 12 abuts the pair of positioning pins 48. Next, the printing plate 12 is conveyed toward the right by the conveying pin 42, and abuts the reference pin 36. In this way, the printing plate 12 is actually positioned at the punching section 16. A predetermined number of punch holes are formed by the punching devices 46 in the front end portion of the printing plate 12 which has been actually positioned. Then, due to the conveying roller 24 rotating reversely, the printing plate 12 is returned onto the plate supplying guide 20. The pair of positioning pins 30 are made to project from the top surface of the plate supplying guide 20, and the printing plate 12 is again temporarily positioned in the same way as described above.

In this state in which the printing plate 12 has been temporarily positioned again, the conveying guide unit 14 is pivoted such that the plate supplying guide 20 corresponds to the exposure section 18. When, simultaneously therewith, the pair of positioning pins 30 are lowered from the top surface of the plate supplying guide 20, the printing plate 12 is conveyed forward by the rotation of the conveying roller 24, and the front end of the printing plate 12 abuts the pair of positioning pins 52 of the rotating drum 50. Then, the printing plate 12 is conveyed toward the right by the conveying pin 42 and abuts the reference pin 36. In this way, the printing plate 12 is actually positioned at the exposure section 18. The front end and the rear end of the printing plate 12, which has been actually positioned, are held on the outer periphery of the rotating drum 50 by the front end chuck 54 and the rear end chuck 64, respectively. Further, while the printing plate 12 is made to fit tightly to the outer periphery of the rotating drum 50 by the squeeze roller 58, the printing plate 12 is wound onto the outer periphery of the rotating drum 50. Thereafter, the rotating drum 50 is rotated at high speed, and exposure processing of the printing plate 12 by the recording head portion 66 is carried out.

When exposure processing is completed, the conveying guide unit 14 is pivoted such that the plate discharging guide 22 corresponds to the rotating drum 50. While the holding of the printing plate 12 on the outer periphery of the rotating drum 50 by the front end chuck 54 and the rear end chuck 64 is released, the printing plate 12 is discharged from the rotating drum 50 to the plate discharging guide 22. Thereafter, the conveying guide unit 14 is pivoted, and the printing plate 12 is conveyed from the plate discharging guide 22 to a developing device or a printing device.

Here, as shown in FIG. 4, at the automatic printing plate exposure device 10, the reference pin 36, which is disposed at its base position, and the conveying pin 42, which is disposed at its base position, are separated by the distance L in the left-right direction. Further, on the basis of the number of driving pulses of the pulse motor 72 from the start of movement of the reference pin 36 from its base position to the time when the reference pin 36 is positioned at the aforementioned predetermined position, the control device 74 computes the distance M which the reference pin 36 has moved toward the left from its base position until it is disposed at the aforementioned predetermined position. Moreover, the control device 74 computes a distance N, which the conveying pin 42 moves from its base position toward the right until the printing plate 12 abuts the reference pin 36, on the basis of the number of driving pulses of the pulse motor 82 from the start of movement of the conveying pin 42 from its base position, to the time the reference sensor 76 detects that the printing plate 12 has abutted the reference pin 36 and the conveying sensor 84 detects that a load of the predetermined amount has been applied to the conveying pin 42 due to the printing plate 12 abutting the reference pin 36.

Thus, due to the control device 74 computing the value L-M-N, the distance W by which the reference pin 36 and the conveying pin 42 are separated in the left-right direction at the time when the position of the printing plate 12 in the right direction is determined, is detected. Namely, the actual size of the printing plate 12 (the actual length W of the printing plate 12 in the left-right direction) is detected on the basis of the computed distance W. Accordingly, the size of the printing plate 12 can be detected by using the reference pin 36 and the conveying pin 42 and the like which position the printing plate 12, and the size of the printing plate 12 can be detected simultaneously with the determination of the position of the printing plate 12 in the right direction. Thus, there is no need to detect the size of the printing plate 12 separately. In this way, there is no need for a separate mechanism for detecting the size of the printing plate 12, and costs can be reduced. Moreover, because a separate period of time for detecting the size of the printing plate 12 is unneeded, it is possible to prevent a deterioration in productivity.

Further, not only can it be detected that the printing plate 12 has abutted the reference pin 36 by the conveying sensor 84 detecting that a load of a predetermined amount has been applied to the conveying pin 42, but also, it can be detected that the printing plate 12 has abutted the reference pin 36 by the reference sensor 76 as well. Accordingly, it can reliably be detected that the printing plate 12 has abutted the reference pin 36.

The present embodiment is a structure in which the conveying sensor 84 and the reference sensor 76 are provided. However, it suffices to provide only the conveying sensor 84. In this case as well, due to the conveying sensor 84 detecting that a load of a predetermined amount has been applied to the conveying pin 42, it can be detected that the printing plate 12 has abutted the reference pin 36.

Moreover, in the present embodiment, the actual length W of the printing plate 12 in the left-right direction is detected at the time the printing plate 12 is temporarily positioned before punching processing. However, the actual length W of the printing plate 12 in the left-right direction (the actual size of the printing plate 12) can be detected at the time the printing plate 12 is actually positioned in the punching section 16, or at the time when the printing plate 12 is temporarily positioned before exposure processing, or at the time the printing plate 12 is actually positioned in the exposure section 18.

Further, the present embodiment may utilize a structure in which the conveying pin 42 is not moved at the time the printing plate 12 is temporarily positioned. In this case as well, when the printing plate 12 is actually positioned in the punching section 16 and the exposure section 18, the printing plate 12 can be made to abut the reference pin 36 by the conveying pin 42, and the actual length W of the printing plate 12 in the left-right direction (the actual size of the printing plate 12) can be detected.

In the present embodiment, the pairs of positioning pins 30, 48, 52 are disposed parallel to the left-right direction. However, a structure may be utilized in which the pairs of positioning pins are not disposed parallel to the left-right direction (the axial direction of the rotating drum).

In place of the pairs of positioning pins 30, 48, 52 in the present embodiment, flat-plate-shaped positioning plates can be used.

In the sheet member positioning device having the above structure, the detecting mechanism detects the distance between the reference member and the conveying member at the time the position of the sheet member in the first direction is determined. Further, because the size of the sheet member is detected on the basis of this detected distance, the size of the sheet member can be detected simultaneously with the determining of the position of the sheet member in the first direction. Accordingly, costs can be reduced, and a deterioration in productivity can be prevented.

What is claimed is:

1. A sheet member positioning device comprising:

a plate on which a sheet member is loaded;

a reference member provided at a side, in a first direction, of the plate, the sheet member being able to abut the reference member;

a judging mechanism which judges whether the sheet member has reached a predetermined position;

a moving device which includes a motor and a control device, the moving device being controlled by the movement of the motor and the control device;

a conveying member provided at a side, in a second direction, of the plate, and due to the conveying member being moved toward the side in the first direction and conveying the sheet member, the conveying member makes the sheet member abut the reference member so as to determine a position of the sheet member in the first direction, wherein the conveying member is moved automatically by the moving device when the judging mechanism judges that said sheet member has reached the predetermined position; and a detecting mechanism which, at a time when the position of the sheet member in the first direction is determined, detects a distance between the reference member and the conveying member, and detects a size of the sheet member on the basis of the detected distance.

2. The sheet member positioning device of claim 1, wherein the reference member is movable upward and downward with respect to a top surface of the plate.

3. The sheet member positioning device of claim 2, wherein the conveying member is moveable upward and downward with respect to the top surface of the plate.

4. The sheet member positioning device of claim 1, wherein the reference member and the conveying member are disposed at substantially opposing positions.

5. The sheet member positioning device of claim 1, wherein the plate has a first slit at the side in the first direction, and the reference member is disposed in the first slit, and the reference member can move within the first slit from the side in the first direction toward the side in the second direction.

6. The sheet member positioning device of claim 5, wherein the plate has a second slit at the side in the second direction, and the conveying member is disposed in the second slit, and the conveying member can move within the second slit from the side in the second direction toward the side in the first direction.

7. The sheet member positioning device of claim 6, wherein the detecting mechanism has a motor, a control device, and a sensor, to detect a condition in which the sheet member is abutting the reference member.

8. The sheet member positioning device of claim 7, wherein the motor is a pulse motor.

9. The sheet member positioning device of claim 7, wherein the detecting mechanism detects that the sheet member, which is conveyed by the conveying member, has abutted the reference member and a load has been applied to the conveying member.

10. The sheet member positioning device of claim 9, wherein the control device detects a distance between the reference member and the conveying member by computing distances which the reference member and the conveying member have moved.

11. The sheet member positioning device of claim 10, wherein the conveying member can move in a state in which a predetermined elastic force is imparted thereto.

12. The sheet member positioning device of claim 11, wherein the sheet member positioning device is applied to a printing plate exposure device.

13. A method of positioning a sheet member in a sheet member positioning device which includes a reference member and a conveying member which are set apart from one another by a predetermined distance, a plate, and a detecting mechanism, the reference member and the conveying member each being automatically movable by a motor and being controlled by a control mechanism, the method comprising the steps of:

(a) supplying a sheet member to the plate;

(b) judging whether the sheet member has reached a predetermined position by a judging mechanism:

(c) automatically abutting the sheet member, which is supplied to the plate, against the reference member, which is provided at a side in a first direction of the plate, by the conveying member after the sheet member reaches the predetermined position;

(d) detecting a distance between the reference member and the conveying member by the detecting mechanism; and (e) detecting a size of the sheet member on the basis of the detected distance.

14. The method of positioning a sheet member of claim 13, wherein, in step (c), the reference member moves toward the conveying member.

15. The method of positioning a sheet member of claim 13, wherein, in step (d), the detecting mechanism computes a distance which the conveying member has moved.

16. The method of positioning a sheet member of claim 13, wherein, in step (d), the detecting mechanism computes a distance which the reference member has moved.

17. The method of positioning a sheet member of claim 13, wherein, in step (d), the detecting mechanism detects the distance between the reference member and the conveying member by subtracting both a moved distance of the conveying member and a moved distance of the reference member which are computed by the detecting mechanism, from a distance by which the reference member and the conveying member are set apart from one another.

18. The method of positioning a sheet member of claim 13, wherein the detecting mechanism has at least one pulse motor connected to the reference member and the conveying member, and in step (d), the detecting mechanism computes distances which the reference member and the conveying member have moved, on the basis of a number of driving pulses of the pulse motor.

19. A sheet member positioning device comprising:

a plate on which a sheet member is loaded;

a reference member provided at a side, in a first direction, of the plate, the sheet member being able to abut the reference member;

a judging mechanism which judges whether the sheet member has reached a predetermined position;

a moving device which includes a motor and a control device, the moving device being controlled by the movement of the motor and the control device:

a conveying member provided at a side, in a second direction, of the plate, and due to the conveying member being moved toward the side in the first direction and conveying the sheet member, the conveying member makes the sheet member abut the reference member so as to determine a position of the sheet member in the first direction, wherein the conveying member is moved automatically by the moving device when the judging mechanism judges that said sheet member has reached the predetermined position; and a detecting mechanism which, at a time when the position of the sheet member in the first direction is determined, detects a distance between the reference member and the conveying member, and detects a size of the sheet member on the basis of the detected distance, wherein the detecting mechanism has a motor, a control device, and a sensor, to detect a condition in which the sheet member is abutting the reference member.

20. A method of positioning a sheet member in a sheet member positioning device which includes a reference member and a conveying member which are set apart from one another by a predetermined distance, a plate, and a detecting mechanism, the reference member and the conveying member each being automatically movable by a motor and being controlled by a control mechanism, the method comprising the steps of:

(a) supplying a sheet member to the plate;

(b) judging whether the sheet member has reached a predetermined position by a judging mechanism;

(c) automatically abutting the sheet member, which is supplied to the plate, against the reference member, which is provided at a side in a first direction of the plate, by the conveying member after the sheet member reaches the predetermined position;

(d) detecting a distance between the reference member and the conveying member by the detecting mechanism; and (e) detecting a size of the sheet member on the basis of the detected distance, and wherein the detecting mechanism has at least one pulse motor connected to the reference member and the conveying member, and in step (d), the detecting mechanism computes distances which the reference member and the conveying member have moved, on the basis of a number of driving pulses of the pulse motor.

* * * * *